US005655224A

United States Patent [19]

Sears

[11] Patent Number: 5,655,224

[45] Date of Patent: Aug. 12, 1997

[54] DETACHABLE FLOWER WIRE TIE

[76] Inventor: Betsy G. Sears, 876 Lexington St., Hemet, Calif. 92545

[21] Appl. No.: 616,639

[22] Filed: Mar. 15, 1996

Related U.S. Application Data

[63] Continuation-in-part of Ser. No. 501,477, Jul. 12, 1995, abandoned.

[51] Int. Cl.[6] ..... A42C 5/00

[52] U.S. Cl. ..... 2/171; 2/207; 2/DIG. 11; 132/273; 428/24

[58] Field of Search ..... 2/171, 207, 209.3, 2/DIG. 11; 132/273, 275; 428/24

[56] References Cited

U.S. PATENT DOCUMENTS

| | | | |
|---|---|---|---|
| 1,548,246 | 8/1925 | Bennett . | |
| 2,474,148 | 6/1949 | Horton . | |
| 2,795,232 | 6/1957 | Klein et al. . | |
| 4,324,821 | 4/1982 | Heineman, III | 428/24 |
| 5,144,696 | 9/1992 | Kahl . | |
| 5,156,171 | 10/1992 | Goodman . | |
| 5,233,704 | 8/1993 | Booher . | |
| 5,303,723 | 4/1994 | Schach . | |
| 5,388,598 | 2/1995 | Whitten . | |

FOREIGN PATENT DOCUMENTS

| | | | |
|---|---|---|---|
| 2255696 | 5/1974 | Germany | 428/24 |

*Primary Examiner*—Diana Biefeld

*Attorney, Agent, or Firm*—Richard C. Litman

[57] ABSTRACT

A detachable flower wire tie including a fabric stem enclosing a pliable metal wire, the wire having a hook formed at each of its ends, a pair of bulbs made by wrapping the corresponding ends of the stem around each of the hooks, and a pair of detachable fabric rings, each enclosing an elastic band designed to slidably engage the fabric stem in a functional and decorative manner, particularly when the flowerette and its corresponding bulb are in close proximity to one another and the stem ends are twisted together, similar to a pair of interlocking flowers.

15 Claims, 4 Drawing Sheets

DETACHABLE FLOWER WIRE TIE

CROSS-REFERENCE TO RELATED APPLICATION

This application is a continuation-in-part of application Ser. No. 08/501,477, filed Jul. 12, 1995, now abandoned.

BACKGROUND OF THE INVENTION

1. Field of the Invention

The present invention relates to the field of ornamental and functional clothing devices used to adorn a wearer as the wearer desires, and particularly to hairbands, hatbands, and waistbands.

2. Description of the Prior Art

A hairband is usually a fixed assembly of components. Such components are not normally interchangeable. If a wearer desires to have an ornamental appearance which intermingles an array of differing fabrics or textiles, the wearer is predisposed to buy a separate assembly for such a look. With respect to function, if one of the components in the fixed assembly ever needs repairing, the wearer is not in the position to merely interchange one of the components. Instead, the wearer is forced to buy a separate assembly, once again. Examples of such prior art include U.S. Pat. No. 5,156,171, issued Oct. 20, 1992, to Joyce E. Goodman; U.S. Pat. No. 5,233,704, issued Aug. 10, 1993, to Ruth E. Booher; and U.S. Pat. No. 5,303,723, issued Apr. 19, 1994 to Debie Schach.

Hairbands which do attempt to allow the wearer to combine different materials for differing decorative appearances usually employ beads squeezed onto a wire loop whereby the beads are secured to the wire by means of a crimp bead. Such hairbands do not allow the wearer to interchange components without the use of a tool to loosen the crimp bead. An example of such prior art includes U.S. Pat. No. 5,388,598, issued Feb. 14, 1995, to Billy F. Whitten.

Another type of hairband, generally considered to be a scarf, is made up of an elastic band and an elongated fabric tube. Even though the band and tube are an interchangeable array of components, the tube is not supported by any internal structure, such as a pliable metal wire. As such, the tube can not be securably adjusted to a desired look which will remain until the wearer chooses otherwise. An example of this prior art includes U.S. Pat. No. 5,144,696, issued Sep. 8, 1992, to Judith A. Kahl.

Other patents which may be considered pertinent to the prior art include U.S. Pat. No. 2,795,232, issued Jun. 11, 1957, to G. J. Klein et al.; U.S. Pat. No. 2,474,148, issued Jun. 21, 1949, to R. J. Horton; and U.S. Pat. No. 1,548,246, issued Aug. 4, 1925.

None of the above inventions and patents, taken either singly or in combination, is seen to describe the instant invention as claimed. Thus a detachable flower wire tie solving the aforementioned problems is desired.

SUMMARY OF THE INVENTION

The present invention includes a detachable flower wire tie having a fabric stem with a first and an opposite second end, a pliable metal wire contained within the stem, a bulb disposed at one of the ends of the stem, and a fabric flowerette adapted to slidably engage the stem after passing over the bulb.

The preferred embodiment includes having the pliable metal wire bent at each of its ends to form a pair of hooks, wherein each hook is wrapped by a corresponding stem end to form a pair of bulbs. Each bulb cooperates in close proximity to a corresponding flowerette to give a decorative appearance of a pair of flowers and a functional attribute of a pair of interlocking members.

Accordingly, it is a principal object of the invention to create an interlocking, decorative clothing device which will resist movement to a position undesired by the wearer.

It is another object of the invention to provide the wearer with an assembly which is a modular device with an unlimited amount of decorative interchangeability.

It is a further object of the invention to allow the wearer to repair the assembly without having to buy a whole, additional unit.

Still another object of the invention is to provide improved elements and arrangements thereof in an apparatus for the purposes described which is inexpensive, dependable and fully effective in accomplishing its intended purposes.

These and other features, advantages and objects of the present invention will be further understood and appreciated by those skilled in the art by reference to the following specification, claims, and annexed drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
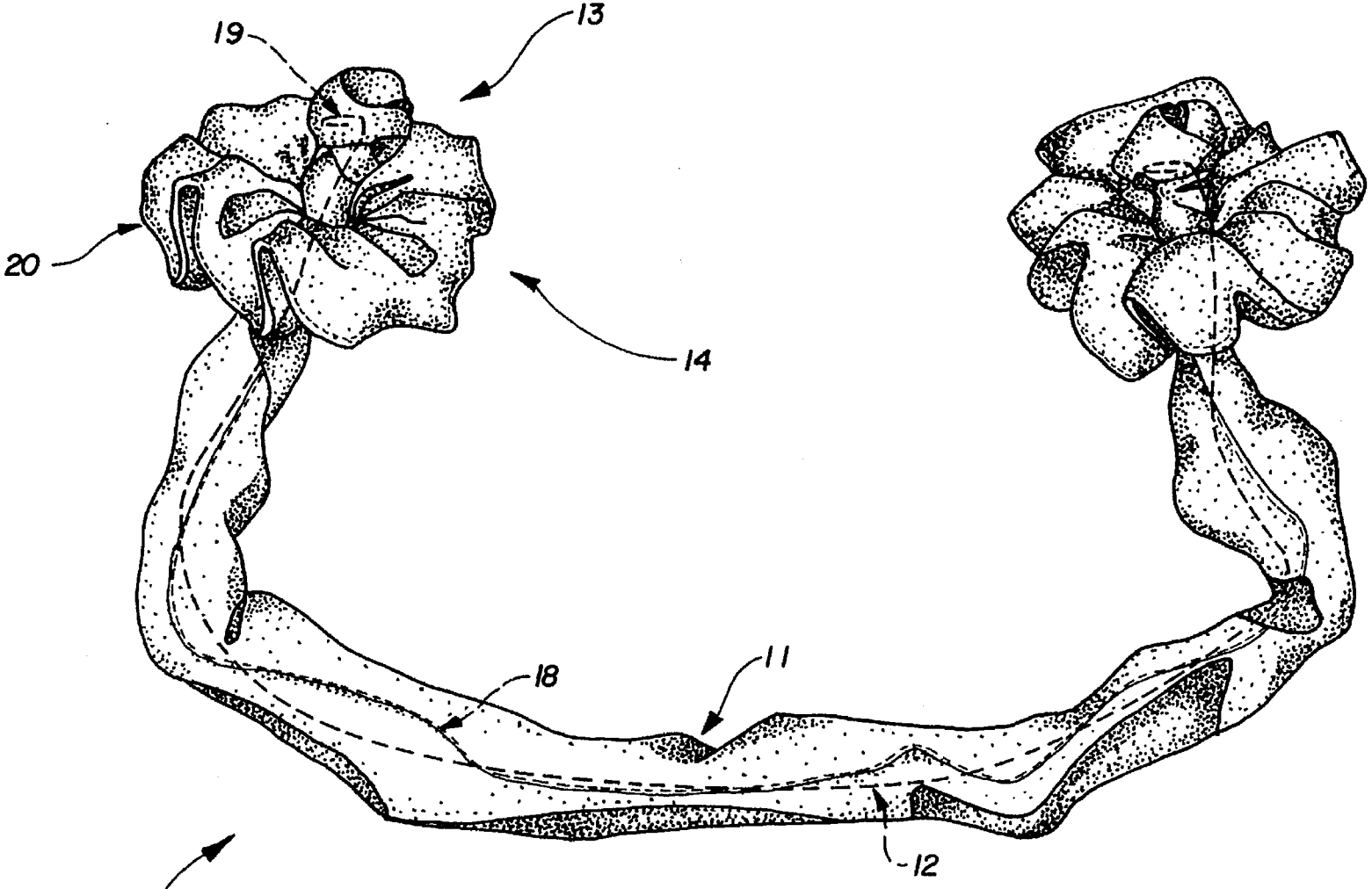
FIG. 1 is a perspective view of a detachable flower wire tie embodying the present invention.
Figure 2:
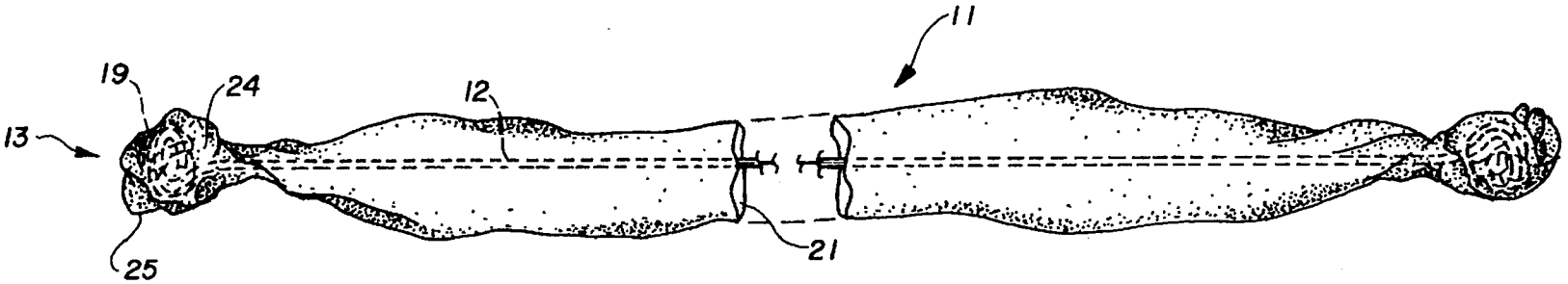
FIG. 2 is a cut-away view of a detachable flower wire tie without flowerettes.
Figure 4:
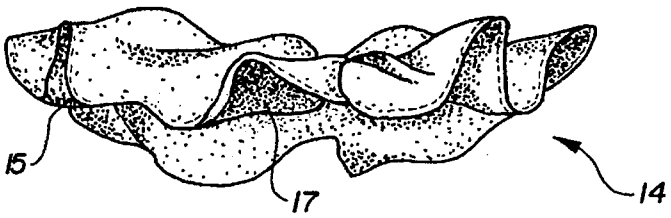
FIG. 4 is a side plan view of a flowerette showing an opening for elastic band insertion and repair.
Figure 3:
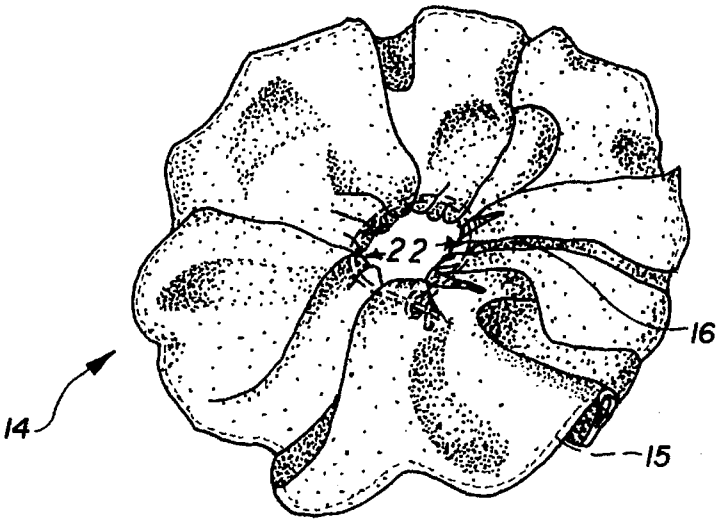
FIG. 3 is a top plan view of a flowerette.
Figure 5:
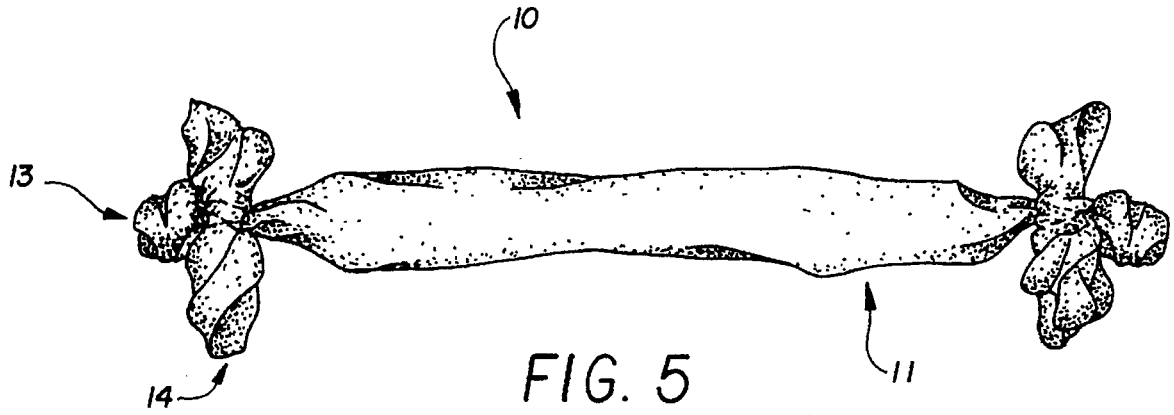
FIG. 5 is a perspective view of a detachable flower wire tie embodying the present invention.

FIGS. 1–5 show a detachable flower wire tie 10 and its detachable components thereof embodying the present invention, including a fabric stem 11 enclosing a pliable metal wire 12, tile wire 12, which runs the length of the stem 11, having a hook formed at each of its opposite ends, a pair of bulbs 13 made by wrapping the ends of the stem 11 around the corresponding hooks 19, and a pair of flowerettes 14 each including an elastic band 16 slidably contained within a fabric ring 20, each flowerette designed to slidably engage the stem 11 in a functional and decorative manner, particularly when the bulb 13 and its corresponding flowerette 14 are in close proximity to one another and the stem 11 ends are twisted together, similar to a pair of interlocking flowers.

Stem 11 is formed of a strip of fabric 36 inches long by 4 inches wide. Stem 11 is folded over and stitched along its edges to form a row of stitches 18 which serves to form a tubular passage 21 within the fabric strip. The stem 11 is then turned inside out such that the row of stitches 18 are right side out. Pliable metal wire 12 is then bent at each of its opposite ends to form a pair of hooks 19 with a radius of approximately ¼ of an inch. The wire 12 is then threaded through the tubular passage 21. The stem 11 is then folded in half. The wire 12 and stem 11 are then wrapped around the index finger, in circular motion, hiding or burying the end into the fabric, forming a first knot 24. This knot 24 is then pulled tightly, and then wrapped around the index finger, in a circular motion the reverse to that used to form the first knot 24, forming a second knot 25. Once the second knot 25 is pulled tightly, the bulb 13 is then assembled. The same operation is repeated at the other end of the stem 11 to form the second bulb 13 should be 26 inches long at completion. The fabric can be any solid or print comprising a recommended content of either a 100% polyester or a 65% polyester/35% cotton blend. The wire 12 can be BELDON p/n 8529 20 awg. (0.52 sq.mm.) solid tin cu. 0.017" (0.43 mm) PVC insulation (0.066" o.d.).

Flowerette 14 is formed by sewing together the ends of a fabric strip 18 inches long by ¾ inches wide with a ¼ of an inch seam in order to form a tube. The tube is folded lengthwise, the edges turned in approximately ¼ of an inch, and then the edges are substantially stitched together to form a fabric ring 20 with a seam 15 along the outer diameter, leaving a small hole 17 for insertion of the elastic band 16 inside the fabric ring 20. The elastic band 16, being 3 inches long by ⅛ of an inch wide, is then threaded through the fabric ring 20 and tied off securely after the inner diameter of the flowerette 14 is adjusted to have a diameter just large enough to slip over the bulb 13 of stem 11. In the preferred embodiment, the inner diameter 22 should be ⅜ of an inch when the elastic band 16 is in a relaxed state, and approximately 1 inch when the elastic band 16 is in a tensioned state. The outer diameter should be approximately 3 inches for the proper look. The elastic band 16 can be that commonly known in the art, as for example, p/n 6726 ⅛" white 2 gr. by Providence Braid Co.

The interchangeability of the flowerettes 14 allows the wearer to achieve an unlimited amount of fashion looks. Furthermore, if one component should need repairing, the wearer has the option of replacing or repairing only that damaged component, not the entire assembly.

To use the detachable flower wire tie 10, it is preferable to have the bulb 13 and the flowerette 14 in close proximity to one another in order to have the decorative effect of a flower. With such cooperation in effect, the ends of the detachable flower tie 10 are twisted together. These ends are securely engaged by the flowers at each end of the stem 11 because they act as interlocking members serving to securely engage the detachable flower wire tie 10 in the position desired by the wearer.

To use the detachable flower wire tie 10 as a headband (FIG. 6), the wearer places the detachable flower wire tie 10 around the wearer's neck region, and then brings it 10 up and behind the ears. With each flowerette 14 in close proximity to the corresponding bulb 13, the ends of the stem 11 are then twisted together at the top of the wearer's head and flattened down to achieve the desired look.

Figure 7:
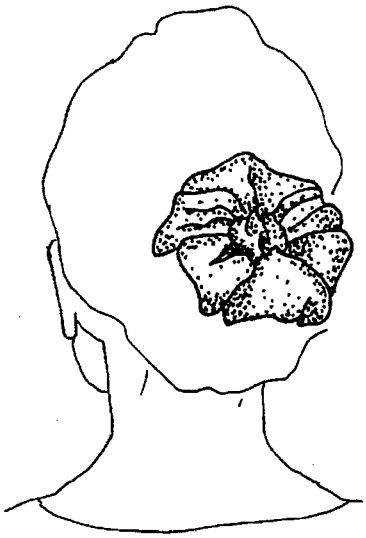
FIG. 7 is an environmental perspective view of a detachable flower wire tie engaged by a wearer in a bun position.

To use the detachable flower wire tie 10 as a bun (FIG. 7), the wearer folds in half a detachable flower wire tie 10, and places hair between the folded stem 11. The wearer then twists the detachable flower wire tie 10 towards the base of the wearer's head a couple of turns, sliding it 10 down towards the ends of the hair. Keeping the tie 10 up above the shoulders, the wearer begins rolling the hair upward until at the base of the head. The ends of the stem 11 are then brought upward and twisted together, with both flowerettes 14 positioned at each end of the stem 11. The flowerettes 14 are then pushed into place for the desired look.

Figure 8:
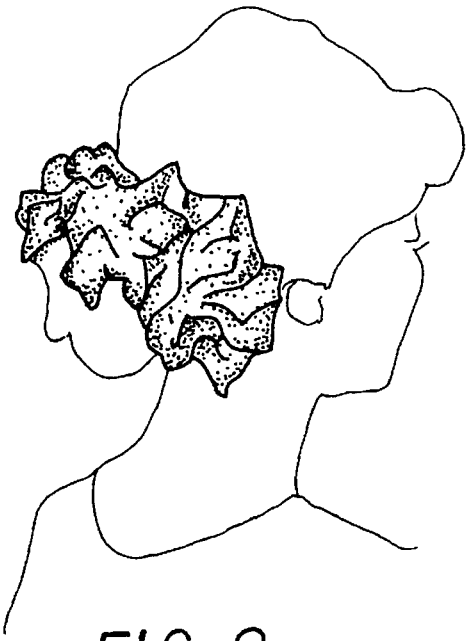
FIG. 8 is an environmental perspective view of a pair of detachable flower wire ties engaged by a wearer in a bun position.

To use the detachable flower wire tie 10 as a double wire bun (FIG. 8), the wearer uses two ties 10. Starting with one tie 10 around the wearer's neck and the other 10 over the hair, the tie 10 which is around the neck is twist the tie 10 under and pull it down using the same method as described for making a single bun in FIG. 7. To finish off the bun, pull the flowerettes 14 up, bring them 14 past each other, and wrap them 14 completely around the bun. The flowerettes 14 are then twisted together and styled as desired.

Figure 9:
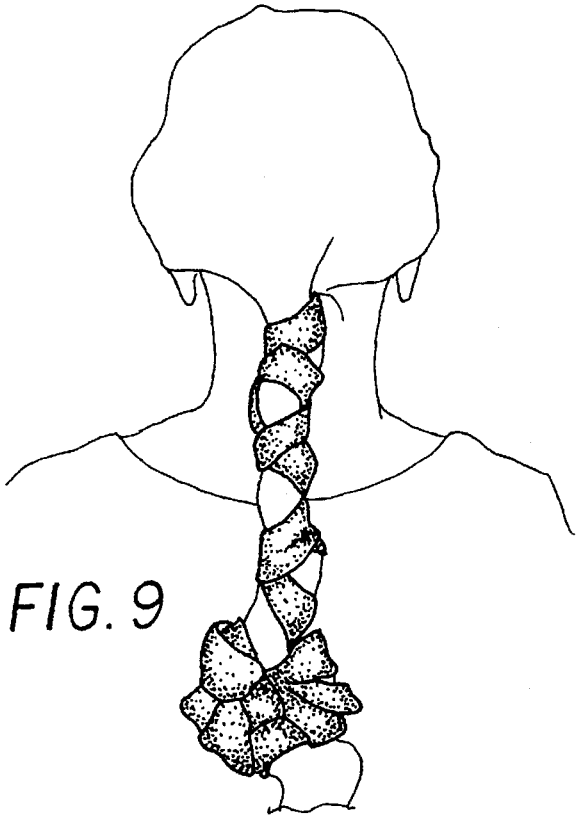
FIG. 9 is an environmental perspective view of a detachable flower wire tie engaged by a wearer in a braided pony tail position.

To use the detachable flower wire tie 10 as a braided pony tail (FIG. 9), the wearer gathers the hair into a pony tail. Starting in the center of the tie 10, wrap the stem 11 around the base of the pony tail until all the wire 12 is used. The ends of the stem 11, with the flowerettes 14 in close proximity to the corresponding bulbs 13, are then twisted together. The wearer then pulls the flowerettes 14 down the length of the pony tail for a braided look.

Figure 6:
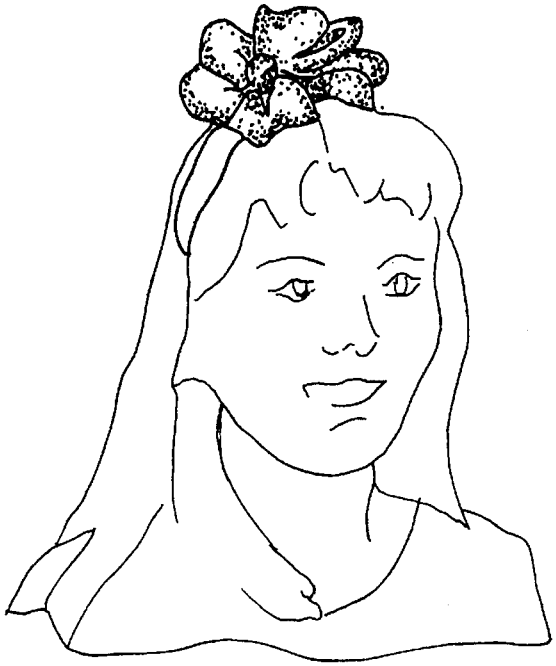
FIG. 6 is an environmental perspective view of a detachable flower wire tie engaged by a wearer in a headband position.
Figure 10:
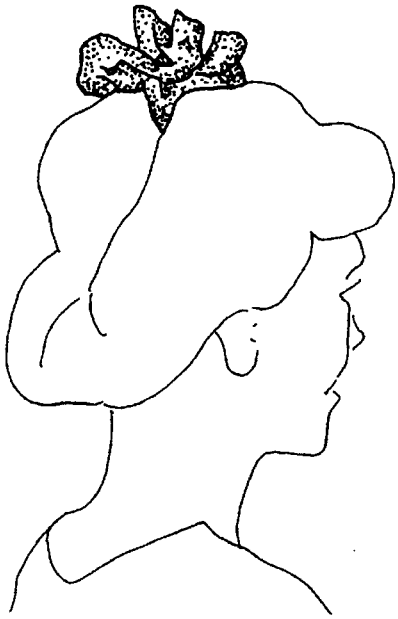
FIG. 10 is an environmental perspective view of a detachable flower wire tie engaged by a wearer in a french roll position.

To use the detachable flower wire tie 10 as a french roll (FIG. 10), the wearer makes a headband as shown in FIG. 6, pulling the tie 10 off once formed. The tie 10 is then place on top of the head in a halo position and secured down with hair pins. The wearer then wraps small portions of hair over the tie 10, tucking it under the tie 10. Alternatively, two ties 10 can be used. Holding the ends of both ties 10 and twisting them upward a couple of times to form a loop, hair is placed inside the loop by rolling it upward into the ties 10. The flowerettes 14 are then brought to the top of the head and the stems 11 are twisted together as with the headband shown in FIG. 6.

Figure 11:
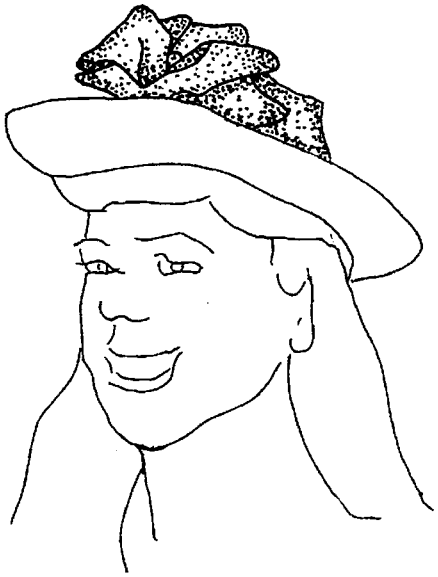
FIG. 11 is an environmental perspective view of a detachable flower wire tie engaged by a wearer as a hatband.

To use the detachable flower wire tie 10 as a hat band (FIG. 11), the tie 10 is wrapped around the brim of a hat and secured at the desired fit. Alternatively, the detachable flower wire tie 10 can be used as a waistband (not shown) by wrapping the tie 10 around the waist as a belt.

It is to be understood that the present invention is not limited to the sole embodiment described above, but encompasses a and all embodiments within the scope of the following claims.

I claim:

1. A detachable flower wire tie comprising:

a fabric stem having a first end and an opposite second end;

a pliable metal wire contained within said stem, said pliable metal wire having a plastic coating;

a bulb disposed at one of said ends of said stem; and a fabric flowerette adapted to slidably engage said stem after passing over said bulb.

2. The detachable flower wire tie as defined in claim 1, wherein said wire is bent at each end to form two hooks.

3. The detachable flower wire tie as defined in claim 1, wherein said stem is hollow and has a length of about twenty to thirty inches.

4. The detachable flower wire tie as defined in claim 3, wherein said bulb includes at least one knot formed by wrapping fabric from a first end of said stem around a hook formed at said first end.

5. The detachable flower wire tie as defined in claim 1, wherein said bulb is made of fabric and the fabric of said stem and bulb comprise a polyester material.

6. The detachable flower wire tie as defined in claim 5, wherein said flowerette comprises the same fabric as said stem.

7. The detachable flower wire tie as defined in claim 1, wherein said flowerette comprises a hollow fabric ring with a first and a second diameter and an elastic band enclosed therein, said flowerette having an inner diameter and an outer diameter, said inner diameter corresponding to said first diameter of said fabric ring as constricted by said elastic band, said outer diameter corresponding to said second diameter of said ring.

8. The detachable flower wire tie as defined in claim 7, wherein said flowerette includes an opening at the circumference of said outer diameter for insertion of said elastic band inside said fabric ring.

9. The detachable flower wire tie as defined in claim 7, wherein said inner diameter of said flowerette has a dimension of about one eighth to five eights of an inch when said elastic band is relaxed.

10. A hair restraint comprising:

a fabric sleeve having a length of about twenty four to twenty eighth inches;

a pliable metal wire enclosed within said sleeve, said wire having a length of about the length of said sleeve, said wire bent at each end to form a hook at each end of said sleeve;

a pair of knots at each end of said sleeve, formed by wrapping the fabric ends of said sleeve around the corresponding wire hooks; and a pair of detachable fabric rings each comprising an elastic band, each said band having, in a stretched condition, an opening with a diameter large enough to accommodate passage therethrough of said knots, whereby said fabric rings can be positioned to surround said knots to form a pair of decorative flowers, whereby a wearer may tightly twist said flowers together to securably engage hair of the wearer.

11. The hair restraint as defined in claim 10 wherein the wire includes a plastic coating.

12. The hair restraint as defined in claim 11 wherein each of said hooks has a radius of about one quarter of an inch.

13. The hair restraint as defined in claim 12 wherein said pair of knots, said pair of fabric rings, and said fabric sleeve comprise a polyester material.

14. The hair restraint as defined in claim 13 wherein said fabric rings have an outer diameter of about two and one half inches to three and one half inches.

15. A detachable flower wire tie comprising:

a fabric stem having a first end and an opposite second end;

a pliable metal wire contained within said stem, said wire being bent at each end to form two hooks;

a bulb disposed at one of said ends of said stem; and a fabric flowerette adapted to slidably engage said stem after passing over said bulb.

* * * * *